US006593549B2

(12) United States Patent
Stevens

(10) Patent No.: US 6,593,549 B2
(45) Date of Patent: Jul. 15, 2003

(54) COOLING DEVICE/HEATER ASSEMBLY INCLUDING A SUPPORTING BRACKET FOR A REFLOW OVEN

(75) Inventor: Rodger L. Stevens, Glendale, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/998,096

(22) Filed: Nov. 30, 2001

(65) Prior Publication Data

US 2003/0102298 A1 Jun. 5, 2003

(51) Int. Cl.[7] ..... H05B 3/06; F27B 9/12; F27B 9/36

(52) U.S. Cl. ..... 219/402; 219/388; 219/400; 219/526; 219/536; 228/222; 228/223

(58) Field of Search ..... 219/402, 388, 219/400, 520, 526, 536; 228/222, 223, 231, 42; 165/61, 64, 104.33

(56) References Cited

U.S. PATENT DOCUMENTS 5,577,658 A * 11/1996 Bailey et al. ..... 228/222
5,611,476 A * 3/1997 Soderlund et al. ..... 228/42
5,993,500 A * 11/1999 Bailey et al. ..... 228/42
6,120,585 A * 9/2000 Inomata et al. ..... 96/377

FOREIGN PATENT DOCUMENTS

FR 2753921 * 4/1998

* cited by examiner

*Primary Examiner*—Joseph Pelham
(74) *Attorney, Agent, or Firm*—Blakely, Sokoloff, Taylor & Zafman LLP

(57) ABSTRACT

A heater is secured to a cooling device in a reflow oven by a bracket comprising a first portion attached to a supporting structure, such as the cooling device itself, and a second portion extending over the heater. A member, preferably a screw, extends through the second portion of the bracket, against the heater. The first portion of the bracket is preferably attached to the cooling device by a screw. The bracket is preferably a stiff material such as aluminum. In addition, the duty cycle of a plurality of heaters on a plurality of respective cooling devices is controlled by a thermocouple on the cooling device closest to the exit of the reflow oven.

30 Claims, 8 Drawing Sheets

COOLING DEVICE/HEATER ASSEMBLY INCLUDING A SUPPORTING BRACKET FOR A REFLOW OVEN

FIELD OF THE INVENTION

The present application relates to reflow ovens and, in particular, cooling components used in reflow ovens.

BACKGROUND OF THE INVENTION

Reflow ovens are used in the manufacture of printed circuit boards ("PCBs") and other electronic devices, where electrical components are connected to the PCB and to each other by solder. In one step of a typical process for manufacturing a PCB, for example, a central processing unit ("CPU") is connected to an interposer or substrate by placing solder paste on the interposer at the desired location for the CPU and placing the CPU onto the solder. The interposer is then placed on a conveyor belt that carries the substrate through the reflow oven. The reflow oven includes a heating section, where heat is generated to melt the solder, and a cooling section to cool and harden the solder, connecting the CPU to the PCB. An example of a reflow oven is the ATMOS 2000CR™ Reflow Oven, available from Electrovert®, Camdenton, Mo.

In the ATMOS 2000CR™ Reflow Oven, cooling gas is provided to three cooling devices that emit the gas onto the PCB. The cooling devices in the ATMOS 2000CR are multi-piece elongated members including an internal longitudinal cavity and a longitudinal slit. Compressed gas is provided to the internal cavity and emitted through the slit in the form of a high velocity laminar flow onto the PCB's as they are carried by the conveyor. FIG. 1 is a perspective view of a portion of a cooling device 10 used in the ATMOS 2000CR. Compressed gas is provided to the internal cavity of the cooling device 10 from a side of the device through a tube 11*a* and an adapter 11*b*. The gas is emitted through a longitudinal slit (not shown) on the PCBs. The cooling device 10 in the ATMOS 2000CR™ Reflow Oven is an Air Knife™ available from Exair Corporation, Cincinnati, Ohio.

Solder paste includes a deoxifying agent, referred to as flux, to remove oxides from the surfaces of the components to be soldered together. The flux typically becomes a vapor at a temperature below the temperature of the heating section and circulates throughout the oven. The vapor condenses on the cooling devices in the ATMOS 2000CR Reflow Oven, clogging the longitudinal slits through which the cooling gas exits the cooling devices. A heater 12 is therefore provided in contact with the cooling device 10 to heat the cooling device and melt the flux during periodic cleaning of the oven. The heater 12 is held against the cooling device 10 by two clips 14 that are bolted to each cooling device 10 through a hole 14*a*. FIG. 1 shows one such clip 14. The clip 14 has a 90° bend 15 and a straight portion 16 that bears against the heater 12, pressing the heater 12 against the cooling device 10. A lip 18 extends perpendicular to the straight portion 16, adjacent to a side of the heater 12, as shown in the rear perspective view of FIG. 2 and in FIG. 3. The clip 14 is formed of a layer of spring steel having a thickness of about 0.889 mm. When connected within the ATMOS 2000CR™ Reflow Oven, the assembly of the cooling device 10, the heater 12 and the clip 14, as shown in FIG. 1, is rotated 180° about a longitudinal axis of the cooling device in FIG. 1 so that the heater is below the cooling device.

The inventor has found that over time the clip 14 may weaken, allowing the heater 12 to separate from the cooling device 10. The cooling device 10 may not, therefore, reach the optimal temperature for melting the flux, typically 200° C. The cooling device 10 may then stay clogged, interfering with its ability to exhaust a sufficient quantity of cooling air to cool the PCB.

In the ATMOS 2000CR™ Reflow Oven, thermocouplesare provided on each of the cooling devices. The duty cycles of the heaters 12 on all three cooling devices 10 are controlled by software based on the temperature sensed by the thermocouple on the middle of the three cooling devices 10. The inventor has also found that the heaters 12 may be turned off before the cooling device 10 closest to the exit reaches the optimal temperature for cleaning.

DETAILED DESCRIPTION OF THE PREFERRED EMBODIMENTS

Figure 4:
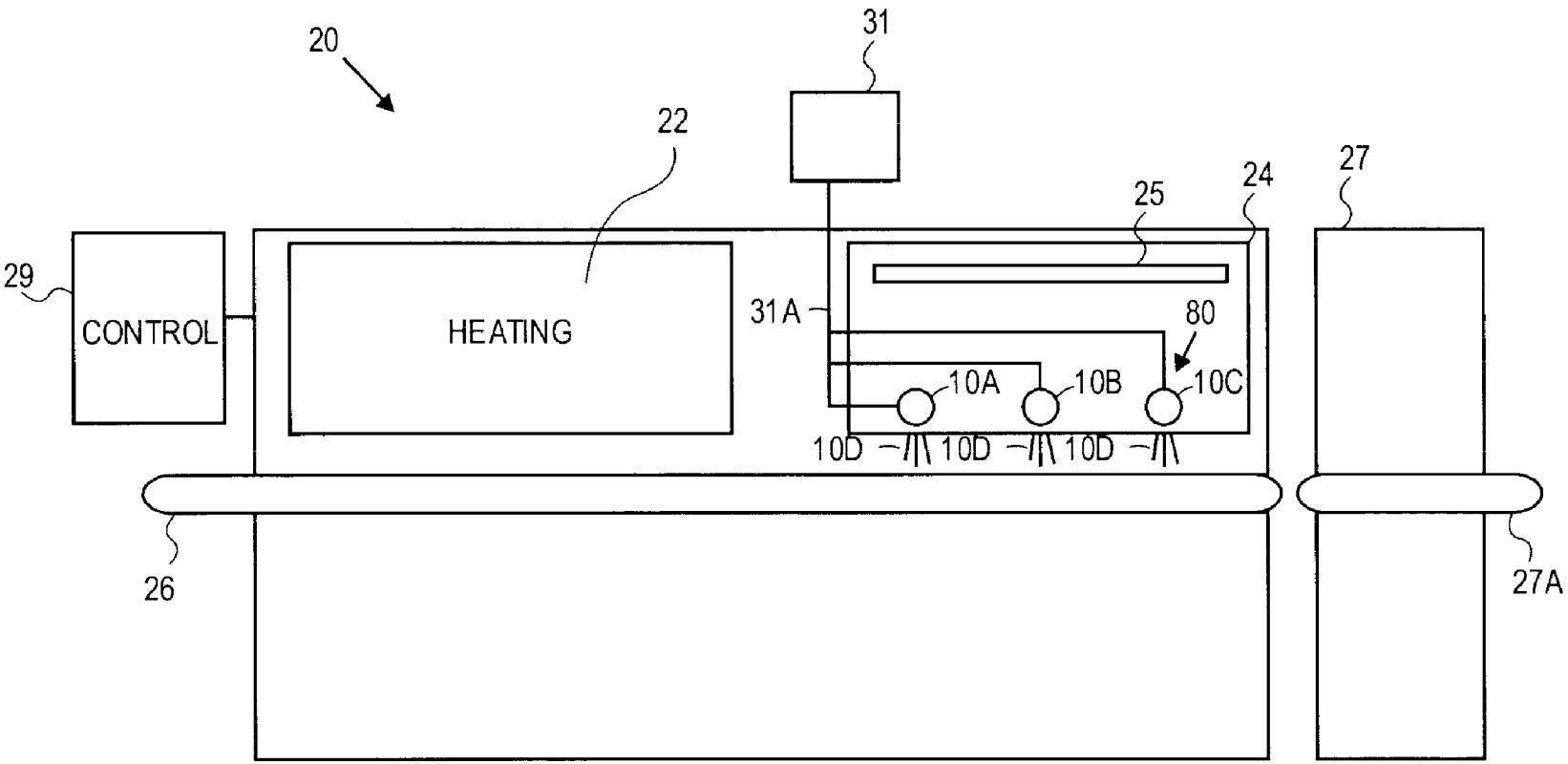
FIG. 4 is a schematic diagram of a forced convection reflow oven, in accordance with one embodiment of the invention.

FIG. 4 is a schematic diagram of a reflow oven 20, such as the ATMOS 2000CR™ Reflow Oven, in accordance with an embodiment of the invention. As briefly described above, the reflow oven 20 comprises a heating section 22, a cooling section 24 and a conveyor system 26 that carries a printed circuit board ("PCB") or other such electronic device (not shown) through the reflow oven 20. A post cooling module 27 may be provided, as well. Operation of the oven 20 is controlled by a computer software control system 29.

The conveyor system 26 may be a pin chain and mesh belt, for example.

The heating section 22 may include top and bottom heaters (not shown) to heat nitrogen or clean dry air. The heaters may comprise heated plates with holes. Blowers (not shown) blow the gas onto and through the plates, providing high volume forced convection heating of the PCB's. The temperature in the heating zone may be from about 240° C. to about 275° C., depending on the solder used and the device being assembled, as is known in the art.

The cooling section 24 may include a radiator 25. Cold water circulates through the radiator 25, cooling the cooling section 24 to a temperature of from about 40° C. to about 50° C. Three gas cooling devices 10*a*, 10*b*, 10*c* are mounted to side walls of the cooling section 24, below the radiator 25. The cooling devices 10*a*, 10*b*, 10*c* are oriented perpendicular to the conveyor belt 26. Compressed clean dry air or nitrogen at room temperature (about 24° C.) is provided from a source 31 through tubes 31*a* to each of the cooling devices 10*a*, 10*b*, 10*c*. A stream 10*d* of a cooling gas of air or nitrogen is emitted by the cooling devices 10*a*, 10*b*, 10*c*, substantially perpendicular to the belt 26 onto the PCB or other such device, as it passes through the cooling section 24. The temperature of the PCB is thereby further reduced. The temperature of a PCB when it enters the cooling section 24 may be about 220° C., for example. The temperature of a PCB when it exits the cooling section 24 may be about 80° C., for example.

The post cooling module 27 is optionally provided to cool the PCB to a temperature safe for handling (about 35° C.–40° C.). The module 27 may comprise a bank of fans (not shown), for example. The post cooling module 27 has its own conveyor belt 27*a*.

Figure 5:
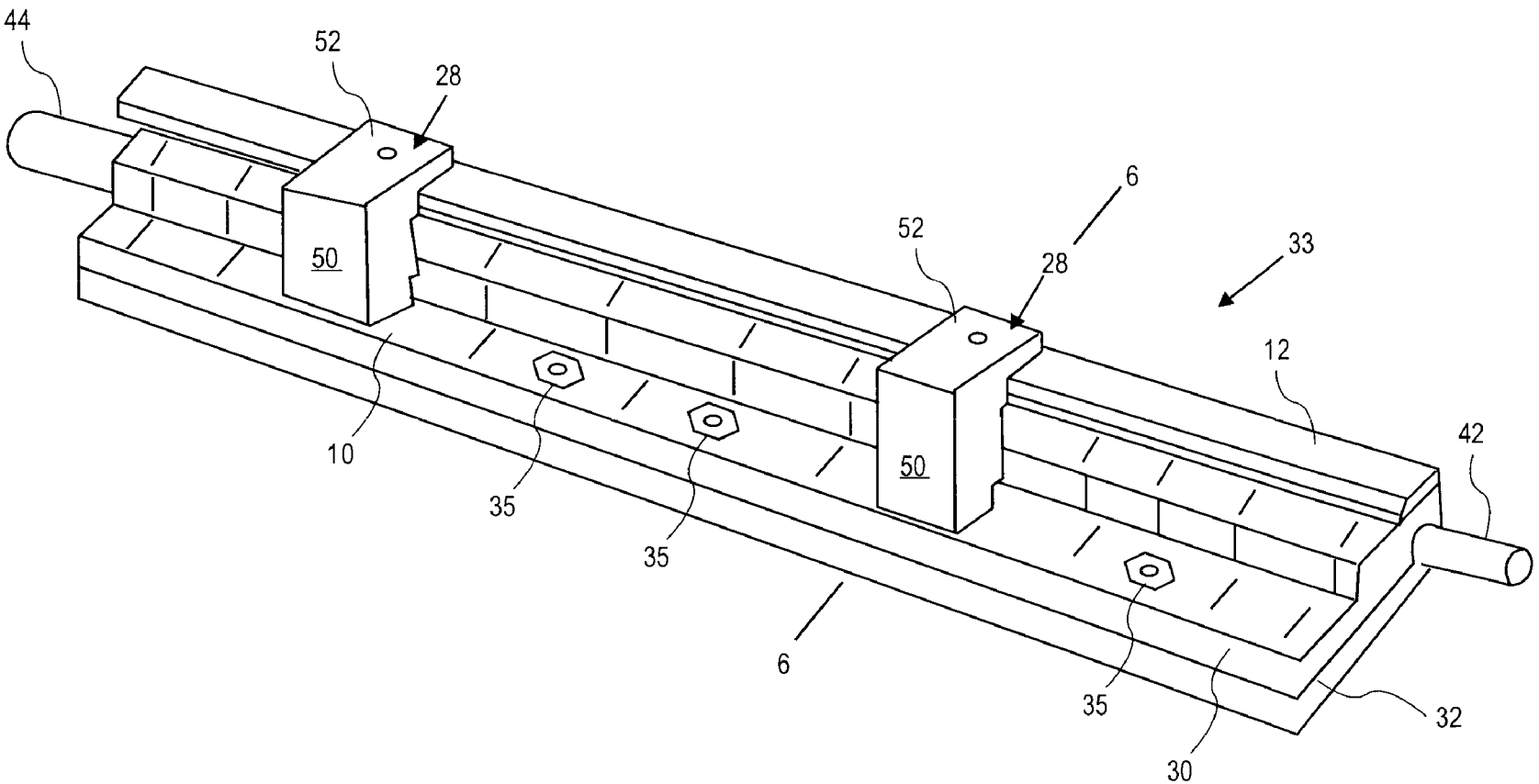
FIG. 5 is a perspective view of an assembly of a cooling device, a heater and a bracket securing the heater to the cooling device, in accordance with one embodiment of the invention.
Figure 6:
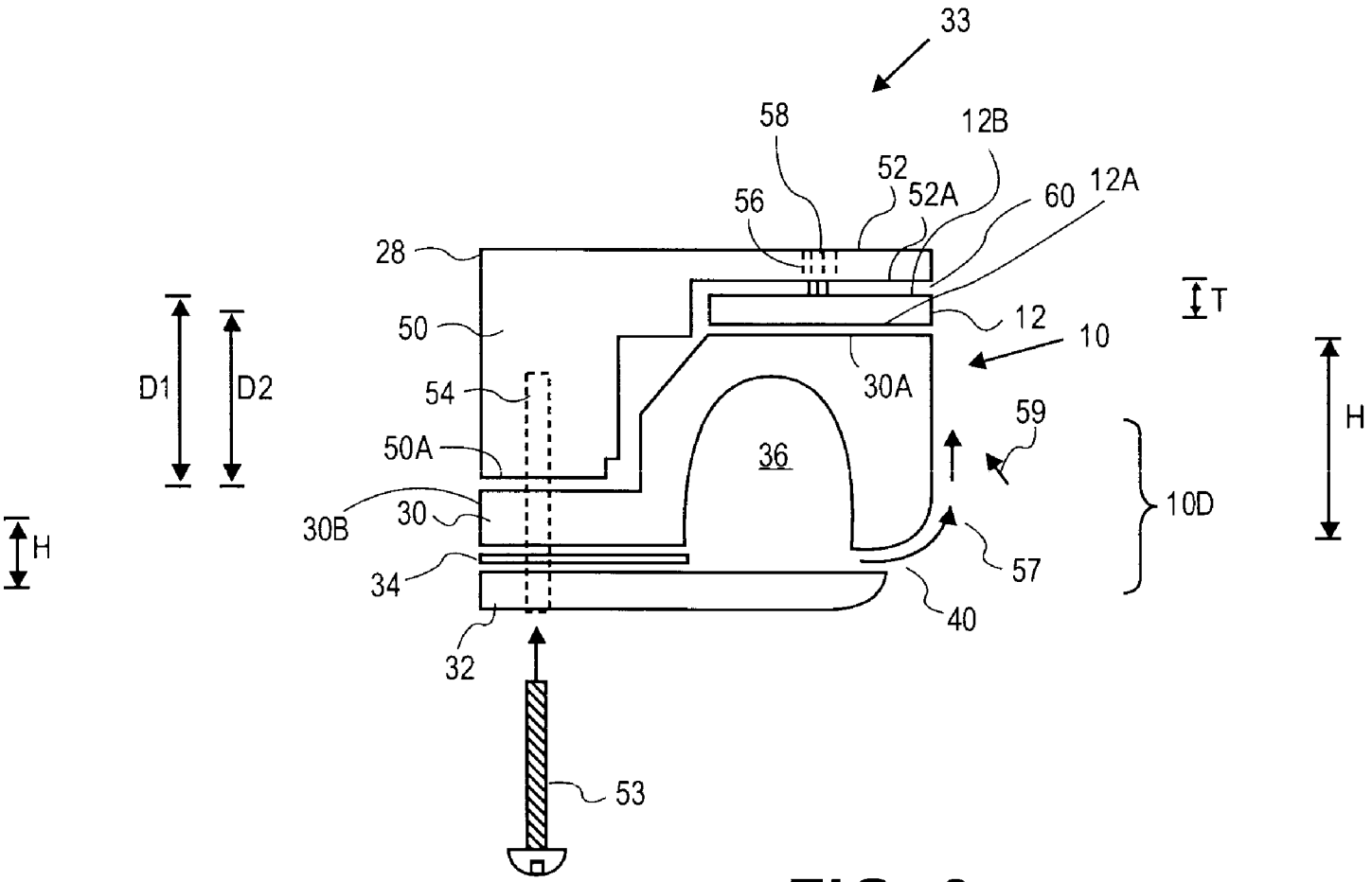
FIG. 6 is a cross-sectional view of the assembly through line 6—6 of FIG. 5.
Figure 8:
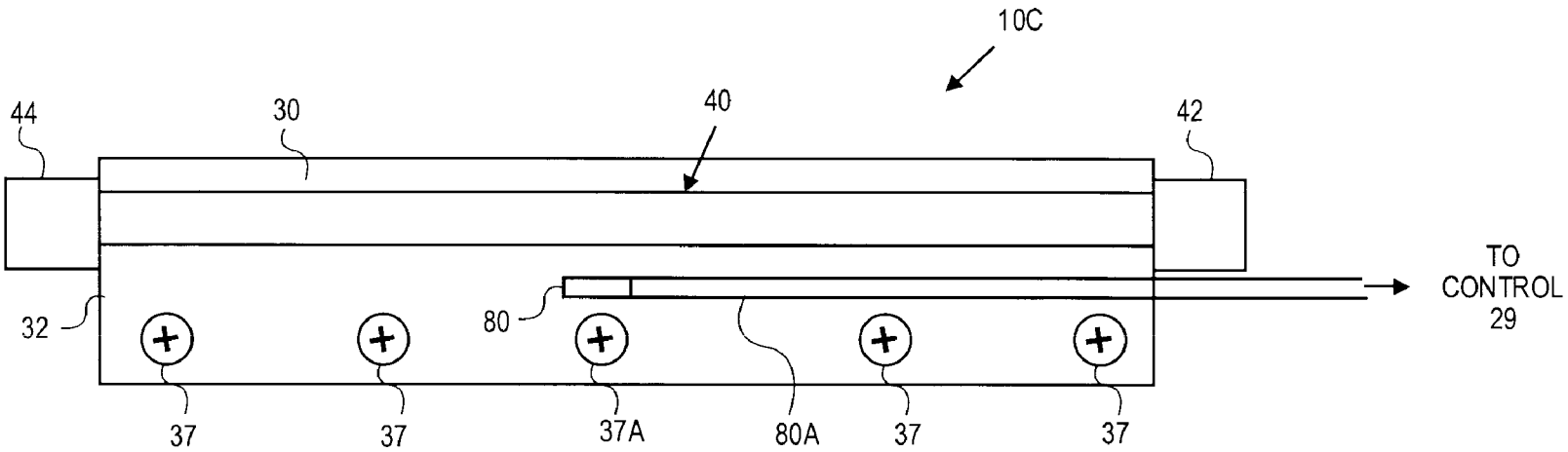
FIG. 8 is a top view of the cooling device of FIG. 5 and FIG. 6, showing a thermocouple mounted to the cooling device.

Each cooling device 10*a*, 10*b*, 10*c* is in contact with a respective heater 12, as discussed above. In accordance with one embodiment of the invention, the heater 12 is secured to the cooling device 10, or another type of cooling device that emits gas through an opening, by brackets 28 to form an assembly 33, as shown in the perspective view of FIG. 5. FIG. 6 is a cross-sectional view of the assembly 33 through line 6—6 of FIG. 5. FIG. 8 is a top view of the cooling device 10.

The cooling device 10 in this implementation comprises a main body 30, a guide plate 32 and a shim plate 34 between the main body 30 and the guide plate 32, best shown in FIG. 6. The main body 30, the guide plate 32 and the shim plate 34 may be connected by screws 37 (shown in FIG. 8) and nuts 35, for example, to form a housing. The main body 30 defines a longitudinal cavity 36 with open ends. The shim plate 34 separates the main body 30 and the guide plate 32, forming a narrow slit 40. It is noted that FIG. 6 is not in proportion and the slit 40 is shown exaggerated for ease of illustration. The slit 40 may have a width of about 0.05 mm, for example. Returning to FIG. 5, cooling gas is provided to the cavity 36 by a tube (not shown) in the wall of the cooling section 24 through an adapter 42 connected to an opening to the cavity 36 at one end of the main body 30. A plug 44 seals an opening to the cavity 36 at the other end of the main body 30.

In this embodiment, the cooling gas provided to the cavity 36 exits through the slit 30. The slit 30 acts as a nozzle, throttling the gas. The gas exits the slit 30 in the form of a high velocity stream that adheres to a Coanda profile of the cooling device 10, as indicated by arrows 57 in FIG. 6. The air stream follows the profile of the cooling device 10 and entrains surrounding air, indicated by arrow 59, amplifying the air stream, as is known in the art. When mounted in the cooling section 24 of the reflow oven 20, the orientation of the assembly 33 in FIGS. 5 and 6 is rotated 180° about a longitudinal axis of the assembly so that the airflow 10*d* is directed downward onto the conveyor belt 26, as indicated schematically in FIG. 4. A cooling device 10 of this configuration is available from Exair Corporation, Cincinnati, Ohio, under the tradename Air Knife™.

The main body 30 preferably has a flat surface 30*a* against which a flat surface 12*a* of the heater 12 is secured, as shown in FIG. 6. The cooling device 10 and the heater 12 may have other shapes, as well.

The heater 12 may be a strip heater comprising a thin, rectangular piece of metal with an internal cavity containing a coil (not shown). Electrical resistance of the coil to current flow generates heat that heats the metal. The strip heater may be connected to a voltage source, such as a 240 volt source, and have a power of 500 watts, for example. An appropriate strip heater is available from Watlow Industries, Hannibal, Mo., under the tradename FIREBAR®. Other types of heaters may be used as well.

A thermal coupling material (not shown), such as a silicon paste, may be provided between the cooling device 10 and the heater 12. An appropriate silicon paste is a Thermal Joint Compound available from EG & Wakefield Engineering Chemical Company, Wakefield, Mass., for example.

Each bracket 28 is preferably a solid piece of a stiff material, such as aluminum. In this embodiment, the bracket 28 has a first, body portion 50 and a second portion or arm 52, extending from the body portion, adjacent to the heater 12 so that the heater 12 is between the arm 52 and the surface 30*a* of the main body 30. In this embodiment, the body portion 50 includes a surface 50*a* connected to the cooling device 10.

A first opening 54 is provided in the body portion 50 of the bracket 28 for receiving a longitudinal member 53, such as a screw, to releasably connect the bracket 28 to the cooling device 10. The connection between the bracket 28 and the cooling device 10 is preferably a releasable connection so that the assembly 33 may be readily disassembled for cleaning. The main body 30 of the cooling device 10 preferably includes a ledge 30*b* overlapping the shim plate 34 and a portion of the guide plate 32. The body portion 50 of the bracket 28 is preferably connected to the ledge 30*b*. The first opening is preferably a threaded opening 54, shown in phantom in FIG. 6. The screw 53 preferably connects the main body 30 to the guide plate 32 and the shim plate 34, and connects the bracket 28 to the ledge 30*b*. The opening 54 and the openings through the main body 30, the guide plate 32 and the shim plate 34 are shown in phantom in FIG. 6. While a releasable connection is preferred, it is not required. The bracket 28 could be welded or otherwise permanently connected to the cooling device 10, instead.

A second opening 56 is provided through the arm 52 to receive a longitudinal member 58 that bears against the heater 12, securing the heater 12 to the cooling device 10. Preferably, the heater 12 is releasably secured against the cooling device 10 to facilitate disassembly for cleaning. The longitudinal member 58 is preferably a screw 58 and the opening 56 is preferably threaded to enable tightening of the screw 58 against the heater 12 to the degree necessary for contact to be maintained between the heater 12 and the cooling device 10. The screw 58 may be a set screw, whose head is recessed within the opening 56 when the screw is tightened. The longitudinal member 58 may also be a rod with protrusions. Once inserted through the opening 56 against the heater 12, the protrusions would resist movement of the longitudinal member and the heater 12.

It has been found that the thickness of the heaters 12 may vary within a wide tolerance.

The distance "D1" between the surface 50*a* of the body portion 50 and the surface 52*a* of the arm 52 adjacent to the heater 12 is therefore preferably sufficiently greater than the distance "D2" between the surface 50*a* and the surface 12*b* of the heater to compensate for the tolerance. A gap 60 will therefore typically exist between the surface 52*a* of the arm 52 and the top surface 12*b* of the heater 12. The gap 60 may be about 1–2 mm, for example.

In the preferred embodiment, the bracket 28, cooling device 10 and heater 12 may be readily disassembled for cleaning by removing the screws 37, the nuts 35 and the screws 53, 58. When reassembled, the heater 12 may be tightly secured to the cooling device 10 by tightening the screw 58.

The bracket 28 may be readily formed of aluminum or other such material by milling.

Figure 7:
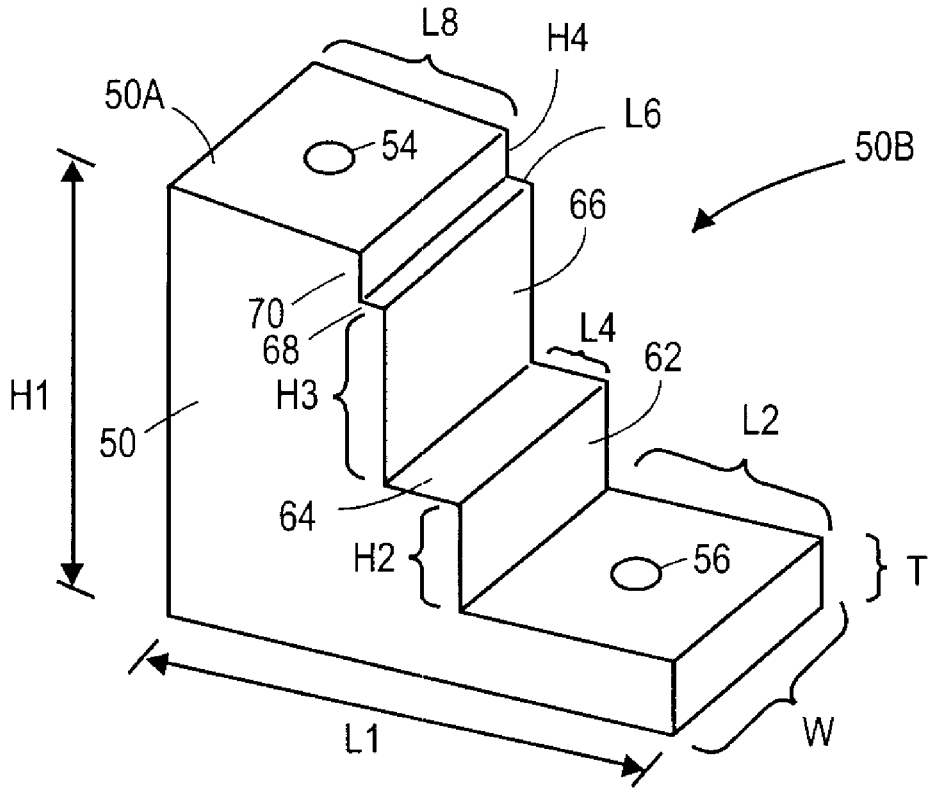
FIG. 7 is a perspective view of the bracket of FIG. 5 and FIG. 6.

FIG. 7 is a perspective view of the bracket 28 of FIG. 5 and FIG. 6. It is preferable that the length "L2" of the arm 52 be minimized to reduce the torque exerted on the arm 52 by the heater 12. In order to minimize the length L2 and to accommodate the contour of the main body 30 of the cooling device 10, the surface 50*b* of the body 50 between the arm 52 and the base 50*a* of the body 50 is preferably stepped. In this embodiment, the bracket 28 includes first, second and third walls 62, 66, 70, separated by first and second ledges 64, 68. A curved surface could also be formed, but would be difficult to mill.

The main body 30 of the Exair Air Knife™ has a length of about 48.3 mm and a height "H" of about 21 mm. (See FIG. 6). The ledge 30*b* has a height "h" of about 7 mm. The heater 12 has a thickness "T" of about 6.5 mm. A preferred bracket 28 for use with such a cooling device 10 and heater 12 has a height "H1" of about 24 mm and a length "L1" of about 32 mm. (See FIG. 7). The arm 52 has a length "L2" of about 14 mm and a thickness "T" of about 3 mm. The first wall 62 has a height "H2" of about 6 mm, the first ledge 64 has a length "L4" of about 3 mm, the second wall 66 has a height "H3" of about 13 mm, the second ledge 68 has a length "L6" of about 2 mm and the third wall 70 has a height "H4" of about 2 mm. The surface 50*a* has a length "L8" of about 12.5 mm. The width "W" of the bracket 28 is about 19 mm. The bracket 28 may have other dimensions, as well.

Two brackets 28 have been found to be sufficient to adequately secure the heater 12 to the cooling device 10. More or fewer brackets may be provided if desired.

As discussed above, the inventor has found that the third cooling device 10*c* (closest to the exit) may not reach the target temperature (200° C.) to melt flux during periodic cleaning of the oven. In accordance with another embodiment of the invention, the duty cycle of the heaters 12 on each of the cooling devices 10 is controlled by software based on the temperature detected by a control thermocouple 80 on the cooling device 10 closest to the exit of the reflow oven 20. In this embodiment, that is the third cooling device 10*c*, as shown in FIG. 4. The control thermocouple 80 may bear against one of the screws 37 attaching the main body 30, the shim plate 34 and the guide plate 32 of the cooling device 10*c*, as shown in the top view of the cooling device 10 in FIG. 8. Preferably, the control thermocouple 80 bears against a screw 37*a* at or near to the middle of the cooling device 10. The control thermocouple 80 is preferably a Type K thermocouple supported on a wire 80*a*. The wire extends along half the length of the cooling device, and is connected to the software control system 29 in FIG. 4. An appropriate thermocouple 80 may be obtained from OMEGA Engineering, Inc., Stamford, Conn., for example. It is noted that thermocouples (not shown) are provided on the first and second cooling devices 10*a*, 10*b*, as well, to enable monitoring of the temperatures of those cooling devices.

The heater control circuit may comprise a single switch controlling the duty cycle of all three heaters 10*a*, 10*b*, 10*c*. The switch is preferably a solid state relay (SSR). The control software is preferably a error correction program, such as a PID (Proportional-Integral-Derivative) program, that maintains the temperature of the cooling devices 10*a*, 10*b*, 10*c* at the target temperature, here 200° C., by varying the duty cycle of the heaters 12 as the target temperature is approached to prevent overshooting and undershooting of the target temperature. The heaters 12 may be operated for a thirty minute cleaning cycle, for example.

Figure 2:
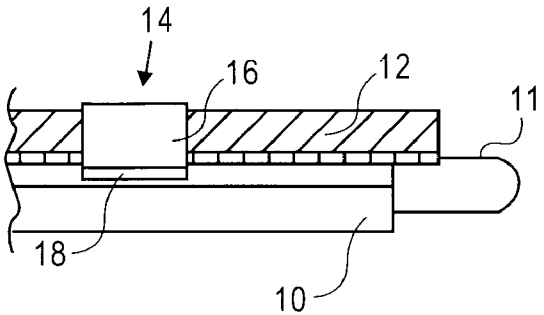
FIG. 2 (PRIOR ART)
FIG. 2 is a rear perspective view of the prior art assembly of FIG. 1.
Figure 3:
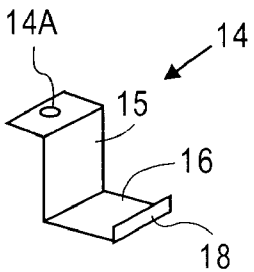
FIG. 3 (PRIOR ART)
FIG. 3 is a perspective view of the prior art clip of FIGS. 1 and FIG. 2.
Figure 1:
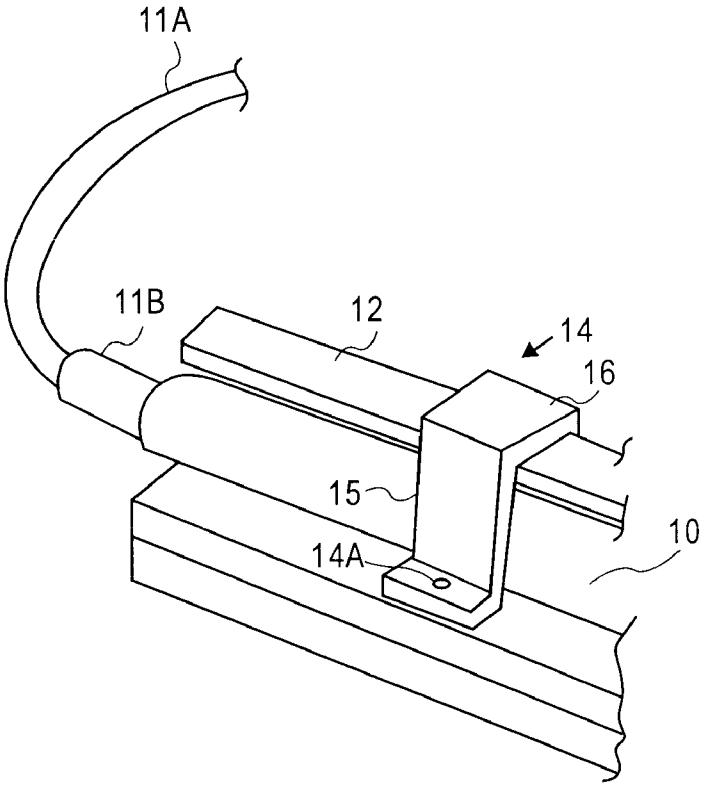
FIG. 1 (PRIOR ART)
FIG. 1 is a front perspective view of a portion of a prior art assembly of a cooling device, a heater and a clip securing the heater to the cooling device.
Figure 9:
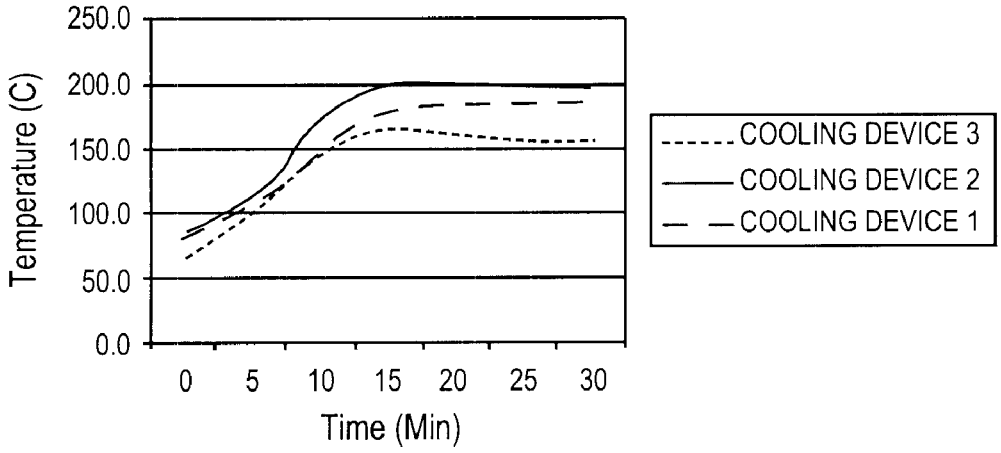
FIG. 9 is a graph of the temperatures of three cooling devices versus time during a cleaning cycle in a prior art reflow oven including the prior art assembly of FIG. 1 and FIG. 2.
Figure 10:
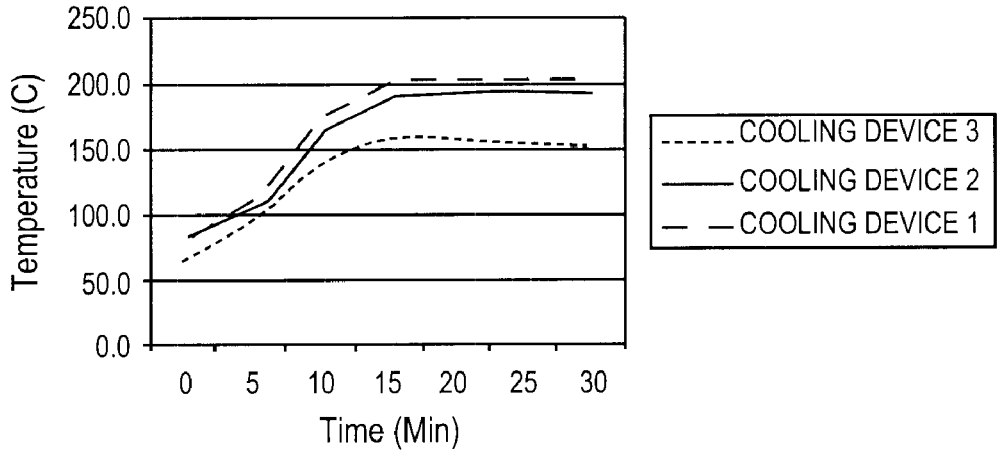
FIG. 10 is a graph of the temperatures of three cooling devices versus time during a cleaning cycle in the reflow oven of FIG. 9, where heaters are secured to cooling devices with the bracket of the embodiment FIGS. 5–7.
Figure 11:
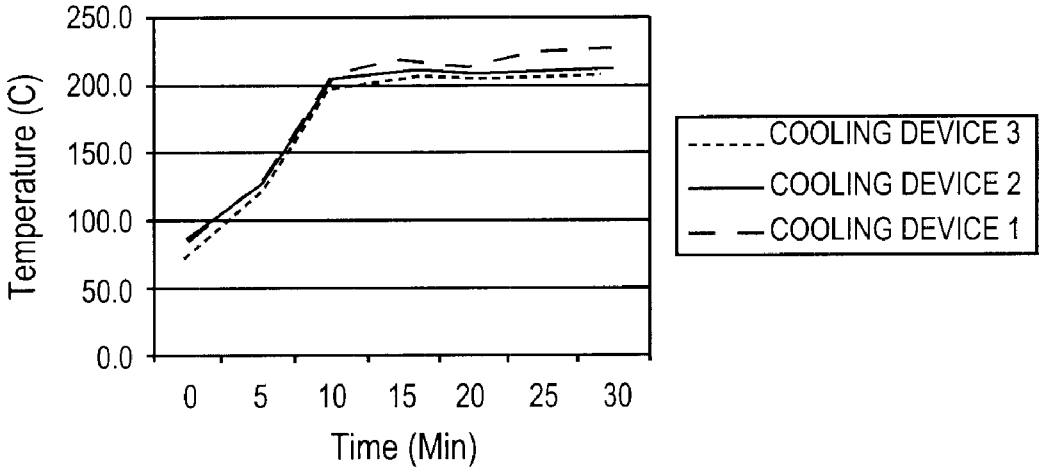
FIG. 11 is a graph of the temperatures of three cooling devices versus time during a cleaning cycle, where heaters are secured to cooling devices with the bracket of the embodiment of FIGS. 5–7 and the control thermocouple is on the third cooling device, as shown in FIG. 4.

FIGS. 9–11 are graphs comparing the effects of replacing the clip 14 of the prior art of FIGS. 1–3 by the bracket 28 and changing the control thermocouple from the middle cooling device 10*b* to the last cooling device 10*c* on the temperatures of the cooling devices 10*a*, 10*b*, 10*c* during a 30 minute cleaning cycle. Temperatures were determined through the thermocouples on each cooling device 10*a*, 10*b*, 10*c*. In FIGS. 9–11, the first cooling device 10*a* is referred to as "Cooling Device 1" in the legends and its temperatures are indicated by long dashed, lines in the graphs. The second cooling device 10*b* is referred to as "Cooling Device 2" in the legends and its temperatures are indicated by solid lines. The third cooling device 10*c* is referred to as "Cooling Device 3" and its temperature is indicated by short dashed lines.

FIG. 9 is a graph of the temperature of each cooling device 10*a*, 10*b*, 10*c* in a conventional ATMOS 2000CR™ Reflow Oven versus time, where the control thermocouple was on the second cooling device 10*b*. As indicated in FIG. 9, neither the first cooling device 10*a* (Cooling Device 1) nor the third cooling device 10*c* (Cooling Device 3) reached the target temperature of 200° C.

FIG. 10 is a graph of the temperature of each cooling device 10*a*, 10*b*, 10*c* versus time, where the heaters 12 were secured to the respective cooling devices by the brackets 28 of the embodiment of FIGS. 4–7. The temperature of the first cooling device 10*a* (Cooling Device 1) was above 200° C., suggesting that the heater 12 associated with the first cooling device 10*a* was not adequately maintained in contact with the first cooling device 10*a* by the clips 14. The temperature of the third cooling device 10*c* (Cooling Device 3) was still below 200° C.

FIG. 11 is a graph of the temperature of each cooling device 10*a*, 10*b*, 10*c* versus time, where the control thermocouple 80 was on the third cooling device 10*c* and the brackets 28 were used. The temperatures of all three cooling devices 10*a*, 10*b*, 10*c* were at or above 200° C.

While the bracket 28 is described for use with a cooling device having the configuration of FIGS. 5 and 6, for example, the bracket 28 could be used with cooling devices of other configurations or with other cooling devices requiring attachment of a heater. For example, the Super Air Knife™, also available from Exair Corporation, Cincinnati, Ohio, may be used. The cooling device may also comprise a single or multi-part member or a tube with a plurality of openings instead of a slit to blow the air. The member or tube may or may not be elongated. The bracket 28 may be readily adapted for use with these or other cooling devices. For example, the shape of the bracket 28 or the location of the screws 57, 58 may be changed, as required.

In addition, the bracket 28 need not be connected to the cooling device 10. Depending on the environment where the cooling device is located, the bracket 28 may be connected to supporting structure in the reflow oven adjacent to the cooling device 10 and the heater 12.

It will be apparent to one skilled in the art that modifications may be made to the embodiments described herein without going beyond the scope of the present invention, which is defined in the claims below.

I claim:

1. An assembly comprising:

a housing having an internal cavity to contain a gas and an opening through the housing through which the gas can be emitted;

a heater contacting the housing;

a bracket comprising a first portion connected to a supporting structure and a second portion extending from the first portion, adjacent to the heater; and a member extending through the second portion of the bracket, against the heater, to secure the heater against the housing.

2. The assembly of claim 1, wherein the supporting structure is the housing.

3. The assembly of claim 2, further comprising a longitudinal member;

wherein the first portion defines a first opening, the housing defines a second opening aligned with the first opening and the first portion is connected to the housing by inserting the longitudinal member through the openings.

4. The assembly of claim 2, wherein the first portion is releasably connected to the housing.

5. The assembly of claim 3, wherein the longitudinal member is a screw.

6. The assembly of claim 3, wherein:

the housing comprises a flat ledge; and the second opening is defined through the ledge.

7. The assembly of claim 2, wherein the member is a screw.

8. The assembly of claim 1, wherein the member is a screw.

9. The assembly of claim 1, wherein a gap is provided between the second portion of the bracket and the heater.

10. The assembly of claim 1, wherein the bracket comprises a stiff material.

11. The assembly of claim 10, wherein the material is aluminum.

12. The assembly of claim 1, wherein the housing has a flat external surface and the heater has a flat surface in contact with the flat external surface of the housing.

13. The assembly of claim 1, comprising a plurality of brackets and a corresponding plurality of members to secure the heater against the housing.

14. The assembly of claim 1, wherein the housing defines an internal cavity to receive gas and an opening for the gas to be emitted from the cavity.

15. An assembly comprising:

a cooling device having an internal cavity to contain a cooling gas, an external surface and at least one opening through the external surface to the cavity to emit cooling gas;

a heater contacting the cooling device;

a first longitudinal member;

a bracket comprising a first portion connected to the cooling device by the first longitudinal member and a second portion extending from the first portion, adjacent to the heater; and a second longitudinal member extending through the second portion of the bracket, against the heater, to secure the heater against the cooling device.

16. The assembly of claim 15, wherein the second longitudinal member is a screw.

17. The assembly of claim 16, wherein the first longitudinal member is a second screw.

18. The assembly of claim 15, wherein a gap is provided between the second portion and the heater.

19. The assembly of claim 15, wherein the bracket is a stiff material.

20. The assembly of claim 19, wherein the material is aluminum.

21. The assembly of claim 15, wherein the cooling device comprises a ledge and the second screw connects the first portion of the bracket to the ledge.

22. The assembly of claim 15, wherein the housing has a flat external surface and the heater has a flat surface in contact with the flat external surface of the housing.

23. The assembly of claim 15, comprising a plurality of brackets and a corresponding plurality of members to secure the heater against the housing.

24. A reflow oven comprising:

a heating section;

a cooling section; and a conveyor to transport an electrical component through the heating oven, from the heating section to the cooling section;

the cooling section comprising an assembly comprising:

a cooling device having an external surface and at least one opening through the external surface to emit a cooling gas;

a heater having a surface in contact with the external surface of the cooling device;

a bracket comprising a first portion connected to a supporting structure within the reflow oven and a second portion extending from the first portion, adjacent to the heater; and a member extending through the second portion, against the heater, to secure the heater to the cooling device.

25. The reflow-oven of claim 24, wherein the cooling section has an exit and comprises a plurality of assemblies, the oven further comprising:

a thermocouple coupled to the assembly closest to the exit; and software to control a duty cycle of each of the heaters based on a temperature detected by the thermocouple.

26. The reflow oven of claim 25, wherein the thermocouple is attached to the cooling device.

27. The reflow oven of claim 24, wherein the supporting structure is the cooling device.

28. The reflow oven of claim 27, wherein the member is a screw.

29. The reflow oven of claim 28, wherein the first portion of the bracket is connected to the cooling device by a second screw.

30. The reflow oven of claim 24, wherein the member is a screw.

* * * * *